US006840746B2

(12) United States Patent
Marshall et al.

(10) Patent No.: US 6,840,746 B2
(45) Date of Patent: Jan. 11, 2005

(54) RESISTIVE SUCTION MUFFLER FOR REFRIGERANT COMPRESSORS

(75) Inventors: Steven Edwin Marshall, Abingdon, VA (US); David Rex Gilliam, Bristol, VA (US); Timothy Michael Wampler, Bluff City, TN (US); David Turner Monk, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 9 days.

(21) Appl. No.: 10/188,276

(22) Filed: Jul. 2, 2002

(65) Prior Publication Data

US 2004/0005225 A1 Jan. 8, 2004

(51) Int. Cl.[7] ..... F04B 53/00

(52) U.S. Cl. ..... 417/312; 417/902; 417/415; 417/313; 181/233; 181/249; 181/248; 181/403; 181/252; 62/296; 62/92; 62/79

(58) Field of Search ..... 417/312, 902, 417/415, 313; 181/403, 233, 249, 252, 247, 248; 62/296; 92/79

(56) References Cited

U.S. PATENT DOCUMENTS

| | | | | |
|---|---|---|---|---|
| 3,142,354 A | | 7/1964 | Kammerer et al. | |
| 3,360,193 A | | 12/1967 | Harris et al. | |
| 4,313,715 A | | 2/1982 | Richardson, Jr. | |
| 4,401,418 A | | 8/1983 | Fritchman | |
| 4,755,108 A | | 7/1988 | Todescat et al. | |
| 4,907,414 A | | 3/1990 | Fraser, Jr. et al. | |
| 4,988,269 A | * | 1/1991 | Blass | 417/312 |
| 5,099,566 A | | 3/1992 | Barrett | |
| 5,101,930 A | | 4/1992 | Fargo et al. | |
| 5,151,018 A | | 9/1992 | Clendenin et al. | |
| 5,164,552 A | * | 11/1992 | Pandeya et al. | 181/249 |
| 5,201,640 A | | 4/1993 | Heinzelmann et al. | |
| 5,203,679 A | * | 4/1993 | Yun et al. | 417/312 |
| 5,205,719 A | * | 4/1993 | Childs et al. | 417/312 |
| 5,304,044 A | | 4/1994 | Wada et al. | |
| 5,499,908 A | * | 3/1996 | Schmitz, III | 417/368 |
| 5,577,898 A | | 11/1996 | Lee | |
| 5,584,674 A | | 12/1996 | Mo | |
| 5,588,810 A | | 12/1996 | DiFlora et al. | |
| 5,605,447 A | | 2/1997 | Kim et al. | |

(List continued on next page.)

FOREIGN PATENT DOCUMENTS

DE 23 42 154 2/1975

*Primary Examiner*—Cheryl J. Tyler
*Assistant Examiner*—Emmanuel Sayoc
(74) *Attorney, Agent, or Firm*—Brian T. Sattizahn; K. Scott O'Brian; McNees Wallace & Nurick, LLC

(57) ABSTRACT

A resistive muffler attenuates sound generated by the gas intake and suction valve during compressor operation of a refrigerant compressor. The resistive muffler is assembled inline with the suction gas flow of the compressor and is positioned within the compressor housing. The resistive muffler attenuates the sound generated by the compressor during its operation as refrigerant gas is drawn into the compressor from an evaporator and passes through the resistive muffler in transit to the suction valve and hence to the region of the compressor where the gas is physically compressed. The resistive muffler includes a muffler housing having an intake end and an exhaust end. An acoustic foam assembly is incorporated into the muffler housing. The acoustic foam assembly is selected on the basis of its ability to absorb sound over a broad range of frequencies and is the muffler containing the acoustic foam is assembled within the compressor so that the sound does not bypass the muffler and transmit significant amounts of the sound to the compressor housing. The acoustic foam remains chemically inert when exposed to the compressor fluids at elevated temperatures of operation, and retains its ability to absorb sound over a broad range of frequencies even when saturated with compressor fluids. The foam assembly should also be able to withstand very large pressure fluctuations without experiencing deterioration.

25 Claims, 4 Drawing Sheets

U.S. PATENT DOCUMENTS 5,703,336 A 12/1997 Tark et al.
5,705,777 A * 1/1998 Flanigan et al. ..... 181/252
5,756,944 A * 5/1998 Battig et al. ..... 181/229
5,810,566 A * 9/1998 Pauwels ..... 417/312
5,949,034 A 9/1999 Kim
5,997,258 A * 12/1999 Sawyer et al. ..... 417/312
6,129,522 A * 10/2000 Seo ..... 417/312
6,257,840 B1 * 7/2001 Ignatiev et al. ..... 417/310
6,398,520 B2 * 6/2002 Han ..... 417/312
6,439,540 B1 * 8/2002 Tse ..... 251/127
6,571,910 B2 * 6/2003 Storm ..... 181/264
2002/0027041 A1 * 3/2002 Czabala et al. ..... 181/229

* cited by examiner

RESISTIVE SUCTION MUFFLER FOR REFRIGERANT COMPRESSORS

FIELD OF THE INVENTION

The present invention is directed to a muffler for use with a compressor, and more specifically to an acoustic resistive muffler for use on the low-pressure side of a compressor used in refrigeration and heating systems.

BACKGROUND OF THE INVENTION

Compressors are one of several components in cooling and heating systems. They are an important component as the compressor is used to compress refrigerant gas used in the system, raising the pressure and the temperature of the gas. Depending on the system, the cycle can be reversed so that the compressor can be used to heat or cool a space. The compressor is typically used in combination with a condenser, expansion valves, an evaporator and blowers to heat or cool a space. Depending upon the direction of the cycle, the system can be used to remove heat from a preselected space or provide heat to a preselected space.

The compressor itself typically is a hermetically sealed device that has an intake port and a discharge port. The hermetically sealed device typically is a metallic shell that houses an electric motor and a mechanical means, such as an impeller or other mechanical portion, for compressing gas. For most compressor designs, the gas cavity enclosed by the housing serves as a reservoir of low-pressure gas to be drawn into the mechanical section of the compressor. The electric motor is connected to a power source that provides line power for operation. The motor in turn drives the means for compressing gas. Compressors are typically categorized by the means used to compress the gas. For example, compressors using a scroll compression device to compress refrigerant gas are referred to as scroll compressors; compressors using a piston device to compress the refrigerant gas are referred to as reciprocating compressors; compressors using rotating screw devices to compress a refrigerant gas are known as screw compressors. While there are differences among the compressors as to how refrigerant gas is compressed, the basic principles of operation as set forth above are common among the compressors, i.e. gas is drawn in through the gas intake when the motor is energized, the gas is compressed in the mechanical portion of the compressor and the highly compressed gas is discharged through an outlet port.

The variations among different compressor designs result in different noise generation mechanisms and overall different noise profiles. Different steps are taken to control or attenuate the sound in the different designs. Despite these efforts, there are common sources of noise for the various types of compressors. For example, a major source of noise can be found at the gas intake or suction port, where gas flow is regulated by a gas intake/suction valve mechanism. The gas intake/suction valve mechanism generates a high-level broadband sound. For hermetically sealed compressors, refrigerant is drawn from a cavity enclosed by the compressor housing into the gas compressing mechanism. During compressor operation, the sound is propagated upstream in the refrigerant gas stream and is radiated from the suction tube or tubes into the compressor's housing cavity. From there, the high level sound is transmitted from the housing cavity through the compressor housing shell and into the space surrounding the compressor. As can be seen, this sound is particularly undesirable when the compressor is located within, adjacent to or near a living area or a work area.

Of course, the sounds generated at the gas intake/suction valve mechanism are not new, and various methods have been attempted to eliminate, reduce or otherwise attenuate compressor noise. For example, it is well known that a foaming agent added to compressor oil will cause a reduction of sound within the compressor. It is believed that the foaming oil acts as an acoustic absorber. While this can be effective, the foaming oil must continue to perform under extremely taxing conditions, as it is exposed to refrigerant and to very high temperatures. The foam must not affect the lubricity of the oil and must not decompose as a result of interaction with the refrigerant and the high temperatures. Of course, if the foam deteriorates under these severe conditions, it loses its effectiveness as an acoustic attenuator. However, even when the foam does not deteriorate, since oil foam tends to be restricted to the bottom of the housing cavity, the foam is only partially effective in reducing the noise.

Other methods that have been utilized include mufflers. Mufflers are of two basic types, reactive mufflers and resistive mufflers. Reactive mufflers have been used to block sound at the suction tubes with limited success. Reactive mufflers are limited in their ability to reduce sound as their design makes them effective over a limited frequency range. These reactive mufflers sometimes utilize a resonator, or increase the length of flow of the gas by having it travel a tortuous path through openings of varying size. While they are effective within the designed frequency range, sound outside this frequency range is unaffected. While the sound energy created by the suction mechanisms of the compressor is broadband in character, the reactive mufflers only attenuate sound across a narrow range of frequencies. The remaining frequencies are propagated. The frequency bands that are propagated are referred to as band-pass frequencies. The designing of reactive mufflers for a predefined frequency region is difficult and even when successful, still does not block the broadband generated by the suction mechanism. Thus, the reactive mufflers tend to act as band-pass filters.

One example of a reactive muffler to muffle sound generated on the suction side of a compressor is set forth in U.S. Pat. No. 6,129,522 to Seo, issued Oct. 10, 2000. Sound is attenuated by passing inlet gas through a series of holes and openings of different sizes.

Resistive mufflers make use of a sound absorptive material to absorb sound over a wide range of frequencies. However, the materials typically used for sound absorbing purposes are not satisfactory choices for use in environments such as the high temperature, high flow velocity environments of refrigerant compressors, in which the materials are also exposed to chemicals such as compressor lubricants and refrigerants.

These resistive mufflers are located within the hermetic seal of the refrigerant compressor, and like other materials within the seal, are exposed to and saturated with lubricant and refrigerant, sometimes at temperatures in excess of 300° F. In addition, the high pressure fluctuations and associated pressure pulsations and vibrations also can adversely affect the sound absorptive materials. Not only is the acoustic performance of the sound insulation material significantly degraded when it is saturated with liquid, but also this harsh environment causes the material to fragment. Of course, the acoustic performance deteriorates as the sound insulation material disintegrates. However, what is more damaging is that the disintegrating material eventually mixes with the lubricating oil in the hermetically sealed compressor. Many insulation materials on dissociation can combine with typical refrigerants to form an acid. This acid can attack the metallic components of the compressor and the entire system. In addition, this material is deposited onto the moving parts with the lubricant. However, this material causes excessive wear and even binding of moving parts such as bearings. Because of this potential for failure of sound absorptive materials within the hermitically sealed compressor and the unsatisfactory results that accompany such failure, there has been a reluctance to incorporate resistive mufflers into refrigerant compressors. For example, polyurethane forms an open cell foam that is an effective acoustic absorber. However, in the harsh environment of a compressor, the cells collapse and the polyurethane combines with lubricants to form an undesirable, viscous fluid. Another effective acoustic absorber is solamide polyimide. But this material dissociates and causes deterioration of bearings.

What is needed is a muffler that absorbs sound over a broad range of frequencies. This is best accomplished by use of a resistive muffler. Therefore, what is needed is a resistive muffler that incorporates a sound insulation material that can survive the harsh environment of a compressor.

SUMMARY OF THE INVENTION

A refrigerant compressor utilizes a resistive muffler to attenuate sound generated by the gas intake and suction valve during compressor operation. The resistive muffler is assembled inline with the suction gas flow of the compressor and is positioned within the compressor housing. The resistive muffler attenuates the sound generated by the compressor during its operation as refrigerant gas is drawn into the compressor from an evaporator and passes through the resistive muffler in transit to the suction valve and hence to the region of the compressor where the gas is physically compressed.

The resistive muffler includes a muffler housing having an intake end and an exhaust end. An acoustic foam assembly is incorporated into the muffler housing. The acoustic foam assembly is selected on the basis of its ability to absorb sound over a broad range of frequencies. Not only must the acoustic foam in the assembly be capable of absorbing sound over a broad range of frequencies, but the foam must be arranged in the muffler and the muffler assembled within the compressor so that the sound does not bypass the muffler and transmit significant amounts of the sound to the compressor housing. The foam assembly desirably should be chemically inert when exposed to compressor fluids. The acoustic foam must be stable, that is, it must not deteriorate when exposed to high temperatures such as experienced in normal compressor operation. The material should remain chemically inert when exposed to the compressor fluids at these elevated temperatures. Ideally, the acoustic foam should substantially retain its ability to absorb sound over a broad range of frequencies even if saturated with compressor fluids. The foam assembly should also be able to withstand very large pressure fluctuations without experiencing deterioration. Furthermore, the fluid entering the resistive muffler should not experience a significant drop in pressure across the muffler housing, that is, the differential between the intake end and the exhaust end should be less than 25%.

An advantage of the present invention is that a compressor that incorporates a resistive muffler allows for sound attenuation over a broad range of frequencies. This lowers the overall level of sound transmitted to the environment proximate to the compressor. It also allows for the elimination of typical reactive mufflers that only absorb sound over a narrow band of frequencies.

Another advantage of the present invention is that the resistive muffler of the present invention incorporates an acoustic foam. The acoustic foam utilized in the present invention will not deteriorate in the harsh environment of the present invention.

Another advantage of the present invention is that the resistive muffler of the present invention will continue to function as an attenuator of sound even when acoustic foam is saturated with lubricant or refrigerant.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
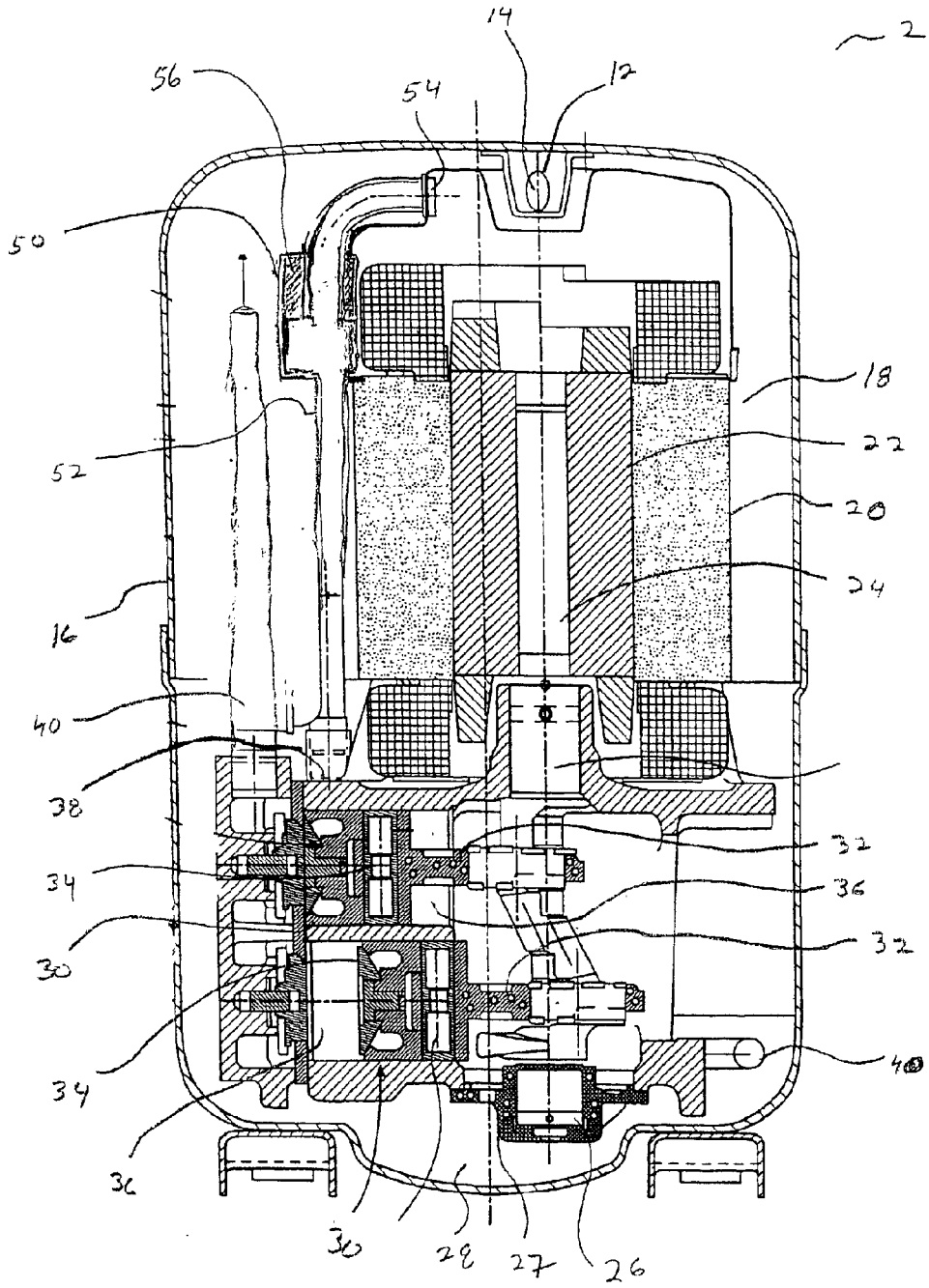
FIG. 1 is a cross-section of a refrigerant compressor that incorporates the resistive muffler of the present invention.

A compressor that incorporates the resistive muffler of the present invention is depicted in FIG. 1. The compressor 2 is connected to a conventional refrigeration system (not shown), such as may be found in a refrigerator, home or automobile, having a condenser, expansion valve and evaporator and conduits connecting these together. Compressor 2 is a reciprocating compressor connected to an evaporator (not shown) by a suction line 12 that enters the suction port 14 of compressor 2. Suction port extends through compressor housing 16 Refrigerant gas from the evaporator enters the low pressure side of compressor 2 through suction port 14.

Compressor 2 includes an electrical motor 18. A standard induction motor having a stator 20 and a rotor 22 is shown. However any other electrical motor may be used. A shaft 24 extends through rotor 22. The bottom end 26 of shaft 24 in this compressor 2 extends into a lubrication sump 28 and includes a series of apertures 27. Connected to shaft 24 below the motor is at least one piston assembly 30. Compressor 2 of FIG. 1 depicts two piston assemblies. A connecting rod 32 is connected to a piston head 34, which moves back and forth within cylinder 36. Cylinder includes a gas inlet port 38 and a gas discharge port 40. Associated with these ports 38, 40 are associated respectively suction valves and discharge valves (not shown) assembled in a manner well known in the art. Suction valve is connected to resistive muffler 50 by exhaust tube 52. Resistive muffler also includes an intake tube 54, which is open to the gas cavity enclosed within compressor housing 16. Resistive muffler includes an acoustic foam 56. Acoustic foam 56 surrounds intake tube 54 which extends substantially into resistive muffler 50, but foam 56 does not extend across the cross-section of intake tube 54, so that the gas flow through intake tube is not impeded by acoustic foam 56.

Motor 18 is activated by a signal in response to a predetermined condition, for example, an electrical signal from a thermostat when a preset temperature is reached. Electricity is supplied to stator 20, and the windings in the stator 20 cause rotor 22 to rotate. Rotation of rotor 22 causes the shaft 24 to turn. In the compressor shown, oil in the sump 28 and which has moved through apertures 27 in bottom end 26 of shaft is moved upward through and along shaft 24 to lubricate the moving parts of compressor 2.

Rotation of rotor 22 also causes reciprocating motion of piston assembly 30. As the assembly moves to an intake position, as piston head 34 moves away from gas inlet port 38, suction valve opens and refrigerant fluid is introduced into an expanding cylinder 36 volume. This gas is pulled from within compressor housing 16 and from suction line 12. This gas is sucked into intake tube 54 and through resistive muffler 50 through exhaust tube 52 to gas inlet port 38 where it passes through suction valve and is introduced into cylinder 36. When piston assembly 30 reaches a first end (or top) of its stroke, shown by movement of piston head 34 to the left side of cylinder 36 of FIG. 1, suction valve closes. The piston head 34 then compresses the refrigerant gas by reducing the cylinder 36 volume. When piston assembly 30 moves to a second end (or bottom) of its stroke, shown by movement of piston head 34 to the right side of cylinder 36 of FIG. 1, a discharge valve is opened and the highly compressed refrigerant gas is expelled through gas discharge port 40 exiting the compressor housing into a conduit connected to a condenser. This comprises one cycle of the piston assembly.

Stator 20 is connected to a source of electrical power (not shown) in the usual manner well known in the art. The motor windings of stator 20 activate rotor 22 which causes shaft 24 to rotate. Shaft rotation causes piston assembly to reciprocate. As the suction valve opens and closes in synchronization with the piston assembly reciprocation, refrigerant gas is drawn into chamber through intake tube 54 and suction line 12. The cyclic opening and closing of the suction valve along with the periodic starting and stopping of the flow of refrigerant gas generates a high level of noise over a broad frequency range. The placement of the muffler in the gas flow path between the suction valve and suction line 12 assists in absorbing the broadband sound generated by the cyclic motion of the suction valve and the cyclic surging of the gas. Use of a resistive muffler allows the sound to be attenuated over a broad frequency range rather than the narrow frequency range such as is damped by a reactive muffler. Sound energy in the frequency ranges that are not damped by reactive mufflers is radiated from the muffler intake tube 54 into the gas cavity enclosed by housing 16. The compressor housing 16 acts as a resonance chamber and retransmits this sound to the surrounding environment. A resistive muffler attenuates sound across a broad range of frequencies so that the level of noise that reaches the compressor housing at any frequency is drastically reduced.

Figure 2:
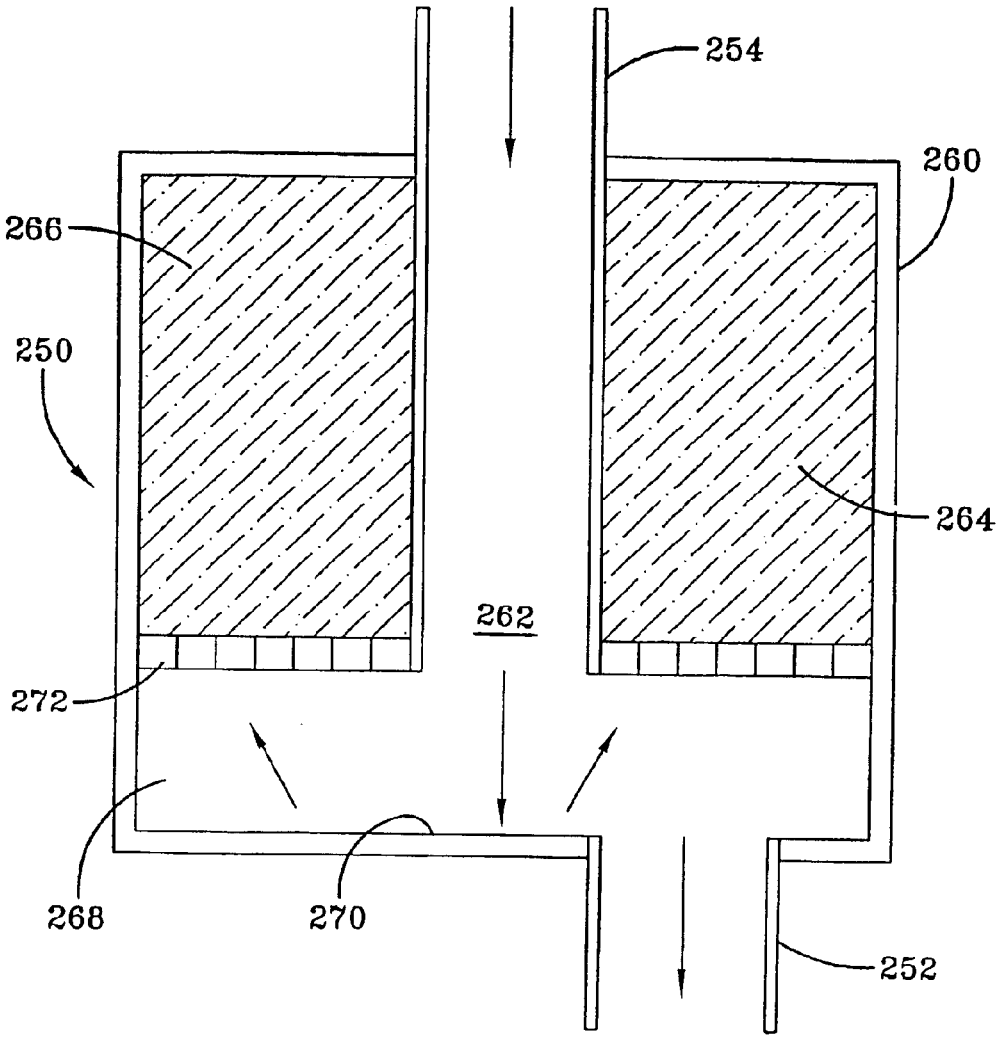
FIG. 2 is a cross section of a first embodiment of the resistive muffler of the present invention in which the acoustic foam occupies only a portion of the muffler chamber adjacent the gas flow path.

An example of a resistive muffler 250 of the present invention is provided in FIG. 2. Muffler 250 includes an a muffler housing 260, an exhaust tube 252 exiting housing 260 on the piston assembly 30 side of muffler and an intake tube 254 entering housing 260 on the suction line 12 side of muffler 250. Housing 260 forms a chamber 262 so that gas passes from intake tube 254 to exhaust tube 252. Intake tube 254 and exhaust tube 252 are offset from one another, that is to say they are not inline, so that gas cannot pass directly from intake tube 254 to exhaust tube 252. Instead the gas must enter into chamber 262 as it passes from intake tube 254 into exhaust tube 252. Chamber 262 is divided into two sections, a portion 264 which is filled with an acoustic foam 266 and a second portion 268 which is a substantially empty space.

It is well known that refrigerant gas is frequently mixed with lubricant, and lubricant is present as a mist. Thus, refrigerant gas entering chamber 262 may contact a surface in second portion 268 of chamber 260, such as surface 270, and be deflected into a first portion containing acoustic foam 266 through a perforated screen 272. The perforated screen 272 separates the first portion from the second portion 268. Any lubricant present as a mist may saturate the foam until a critical amount forms droplets, which leave the foam 266 through the same screen 272 and are drawn into the piston assembly with refrigerant gas. Depending on the temperature and the gas flow rate, a small amount of refrigerant gas may also form a liquid and contribute to the saturation of the foam 266 as it passes through the foam 266. Sound is attenuated by the muffler as sound waves from the suction valve and piston assembly propagate along exhaust tube 252 and contact muffler housing, so that acoustic foam can absorb a portion of the sound, however the flow of refrigerant gas is not changed by the presence of the muffler. The muffler is designed to minimally impede the flow of gas, the primary flow, so as not to degrade compressor performance. Desirably, the pressure drop across the muffler is less than 25%. In addition, sound waves propagated from the suction valve assembly through the gas stream itself are attenuated as the gas stream (and hence the sound waves) contact the acoustic material.

Figure 3:
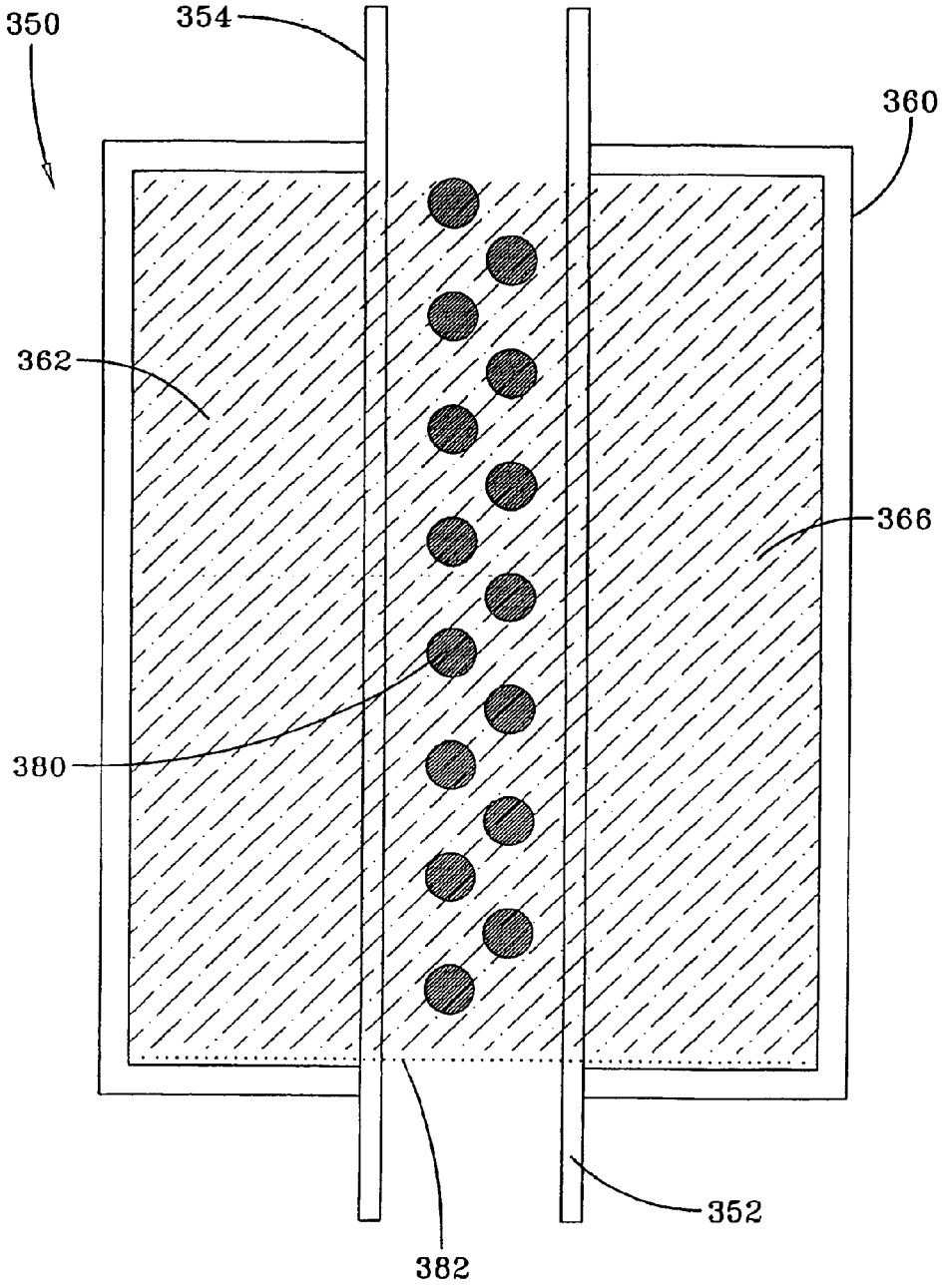
FIG. 3 is a cross section of a second embodiment of the resistive muffler of the present invention in which the acoustic foam occupies the entire portion of the muffler chamber adjacent the gas flow path.

A second embodiment of the present invention is shown in cross section in FIG. 3. Here, resistive muffler 350 includes a muffler housing 360, an exhaust tube 352 exiting housing 360 on the piston assembly 30 side of muffler and an intake tube 354 entering housing 360 on the suction line 12 side of muffler 350. Housing forms a chamber 362 so that gas passes from intake tube 354 to exhaust tube 352. As shown in FIG. 3, intake tube 354 and exhaust tube 352 are contiguous, forming a single tube. This is not required, and intake tube 354 and exhaust tube 352 may be individual tubes connected together, separated by a short distance or separated by the length of the muffler. Housing 360 forms a chamber 362 that is filled with acoustic foam 366. However, in order to take full advantage of the attenuation capabilities of acoustic muffler 350, there must be a path or passageways available to allow gas passing through muffler 350 to contact acoustic foam. This path is provided by a plurality of apertures 380 in contiguous tube 352/354 that forms the primary flow boundaries.

A portion of refrigerant gas entering muffler 350 will pass through the plurality of apertures 380 into acoustic foam 366 and a portion will be sucked directly through exhaust tube 352. Any lubricant present as a mist may saturate the foam until a critical amount forms droplets which leave the foam 366 through lower apertures in the plurality of apertures 380 or through a lower passageway 382 at the bottom of chamber 362 flowably connected to gas stream in contiguous tube 352/354 which are drawn into the piston assembly with refrigerant gas. Refrigerant gas will return to the gas stream through the plurality of apertures 380. Depending on the temperature and the gas flow rate, a small amount of refrigerant gas may also form a liquid and contribute to the saturation of the foam 366 as it passes through the foam 366 passing back into the gas stream with lubricant if not first converted to a gas. Again, sound is attenuated by the muffler as sound waves from the suction valve and piston assembly propagate along exhaust tube 352 and contact muffler housing, so that acoustic foam 366 can absorb a portion of the sound. Sound waves propagated from the suction valve assembly through the gas stream itself are attenuated as the gas stream (and hence the sound waves) contacts the acoustic material. It is not necessary that tube 352/354 pass straight through muffler 350 as shown in FIG. 3, although this configuration will exhibit a minimal pressure drop. The tube may be arcuate within muffler 350, although an accompanying pressure drop will occur with each tube bend.

The material comprising the acoustic foam must be carefully selected in order to provide the acoustic attenuation desired while still being capable of surviving the harsh environmental conditions within the compressor over the life of the compressor. The most important characteristic of the acoustic foam is that it must be capable of absorbing or attenuating sound across a broad range of frequencies. It must also be capable of surviving the high temperatures of the compressor environment, typically 250–300° F. for prolonged periods of time, with periodic temperature spikes in excess of 300° F. for brief periods of time. It must also be inert when contacted by the various lubricants and refrigerants. For example, typical lubricants include mineral oil, polyol ester, polyalkene, glycol and alkyl benzene, while typical refrigerants include for example chlorofluorocarbons (CFCs) and hydrofluorocarbons (HFCs). The acoustic foam must also be capable of attenuating sound when saturated with lubricant, refrigerant or a combination of the two. The acoustic foam may be a composite, wherein a first material having the acoustic absorption capabilities and high temperature capabilities is encased in a second material that is inert to the lubricants and the refrigerants, but which also may survive high temperatures. The encasement prevents the first material from becoming saturated by lubricant or refrigerant. The encasement also prevents the first material from being released into the lubricant or the refrigerant if it should disintegrate.

One acceptable material for an acoustic foam is melamine foam which can survive in the environment of a compressor for the life of the compressor. It can act as an attenuator over a broad frequency range and retains its attenuation capabilities even when wet. Thus, melamine foam, an open cell foam, is not required to be encased as a composite material. Melamine foam is manufactured by BASF Corporation of Aktiengesellschaft, Germany. Melamine is formed by heating urea and ammonia. The resulting mixture of isocyanic acid and ammonia reacts over a solid catalyst at a temperature of about 400° C. to form melamine. The melamine resin is formed into an open cell foam.

Other materials that have good acoustic characteristics include, for example, fiberglass and steel wool. However, these materials are comprised of fibrous materials that can come apart when exposed to the flow rates and pressures experienced in the compressor. These fibers can damage moving parts. However, these materials can be effective if contained. Thus encasing these materials with a second material that is inert to compressor fluids is preferable. These fiber materials may be used if encased or encapsulated in a material such as mylar, nylon or other engineered plastics or if encompassed within a filter that can survive the harsh environmental conditions of a compressor. However, these materials may be used without an encasement or filter. Alternatively, the individual fibers may be coated with a suitable inert material in contrast to encasing the fibrous materials within the inert material.

Figure 4:
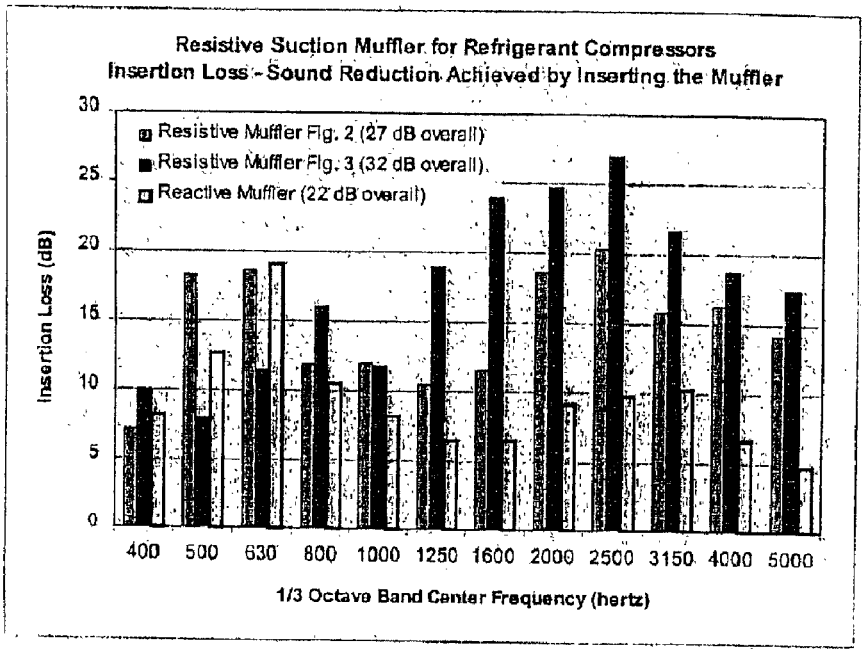
FIG. 4 is a graphic display of muffler insertion loss for the mufflers of FIG. 2 and FIG. 3 at various frequencies.

A compressor system using the resistive suction muffler of the present invention was built and tested. The muffler configurations of both FIG. 2 and FIG. 3 were evaluated. The acoustic material utilized was melamine open-cell foam. A standard acoustic metric for rating muffler performance was employed to judge the effectiveness of the resistive mufflers. The acoustic metric used is the muffler "insertion loss." Insertion loss is the decibel reduction in sound pressure on the downstream side of sound propagation when a muffler is inserted in the sound flow path. For the case of the compressor suction muffler, the dynamic pressure at the inlet tubes 254, 354 were subtracted from the dynamic pressure at an equivalent inlet to a uniform tube running straight into the compressor inlet port. The insertion losses for the two muffler configurations are graphed as a function of ⅓ octave band levels in FIG. 4. Also shown in this FIG. 4 is the insertion loss of a typical reactive muffler. The figure clearly demonstrates the broadband effectiveness of the resistive mufflers compared to the reactive mufflers. The resistive muffler of FIG. 2 achieves a 27 dB overall reduction in the sound energy propagating upstream in the suction gas, and the resistive muffler of FIG. 3 achieves a 32 dB overall reduction. By comparison, the reactive muffler only achieves a 22 dB overall reduction in the sound energy. Hence, the resistive mufflers absorb at least twice the sound energy as the reactive muffler.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An acoustic muffler, comprising:

a muffler housing positioned within a compressor housing of a reciprocating refrigerant compressor;

an intake tube at a first end of the muffler housing for receiving a flow of refrigerant fluid;

an exhaust tube at a second end opposed of the muffler housing to exhaust the flow of refrigerant fluid;

an acoustic foam assembly positioned within the muffler housing adjacent to but outside the primary flow of the fluid, the foam assembly being chemically inert to compressor fluids, the acoustic foam assembly characterized by its ability to attenuate sound over a broad range of sound frequencies, even when saturated with compressor fluids, and further characterized by stability at high temperatures and fluctuating pressures experienced in normal compressor operation; and wherein the muffler housing and foam assembly are assembled within the compressor as a muffler so that sound generated by the flow of gas into a piston assembly of the compressor does not bypass the muffler, which attenuates noise resulting from compressor operation substantially reducing sound retransmitted to the compressor housing.

2. The acoustic muffler of claim 1 wherein the acoustic foam assembly retains its ability to attenuate sound over a broad range of frequencies when saturated with compressor fluids.

3. The acoustic muffler of claim 1 wherein the muffler housing is divided into two portions, a first portion filled with acoustic foam and a second portion free of material.

4. The acoustic muffler of claim 3 further comprising a perforated screen separating the first portion from the second portion.

5. The acoustic muffler of claim 3 wherein the intake tube at the first end of the muffler housing and the exhaust tube at the second end of the muffler housing are not in a straight line.

6. The acoustic muffler of claim 5 wherein fluid passing from the intake tube to the exhaust tube passes through the muffler housing.

7. The acoustic muffler of claim 5 wherein a portion of the fluid entering the muffler housing first passes into acoustic foam and then into the exhaust tube.

8. The acoustic muffler of claim 6 wherein the pressure drop across the muffler housing is sufficiently low so as not to impede primary flow.

9. The acoustic muffler of claim 1 wherein the muffler housing is a single chamber substantially filled with acoustic foam surrounding the primary flow of fluid from the intake tube to the exhaust tube, the muffler housing connected to the intake tube and the exhaust tube.

10. The acoustic muffler of claim 9 wherein the intake tube and exhaust tube are contiguous forming a single tube for passage of the primary flow of fluid.

11. The acoustic muffler of claim 9 wherein the muffler housing includes a passageway to allow a flow of fluid from the primary flow path through the acoustic muffler.

12. The acoustic muffler of claim 11 wherein the passageway includes a plurality of apertures in a primary flow boundary of the fluid.

13. The acoustic muffler of claim 1 wherein the acoustic foam is an open cell foam.

14. The acoustic muffler of claim 13 wherein the open cell foam is formed by reaction of isocyanic acid and ammonia.

15. The acoustic muffler of claim 14 wherein the open cell foam is melamine.

16. The acoustic muffler of claim 1 wherein the acoustic foam is a composite material.

17. The acoustic muffler of claim 16 wherein the composite material is a foam formed by encasing a fibrous, sound attenuating material in a material that is inert to compressor fluids.

18. The acoustic muffler of claim 17 wherein the inert material is mylar.

19. The acoustic muffler of claim 1 wherein noise of compressor operation is attenuated by at least about 6 decibels across a range from about 400 Hz to about 5000 Hz.

20. The acoustic muffler of claim 19 wherein noise of compressor operation is attenuated by at least about 10 decibels across a range from about 600 Hz to about 5000 Hz.

21. A refrigerant compressor comprising:

a compressor housing;

a suction line extending through the compressor housing to introduce refrigerant fluid into the compressor housing;

an intake tube within the compressor housing for receiving refrigerant fluid introduced into the compressor housing;

an exhaust tube to receive refrigerant fluid from the intake tube;

a resistive muffler positioned within the compressor housing between the intake tube and the exhaust tube, the resistive muffler including an acoustic foam assembly positioned within a muffler housing adjacent to but outside the primary flow of fluid through the muffler, the foam assembly being chemically inert to compressor refrigerant fluids, the acoustic foam assembly characterized by its ability to attenuate sound over a broad range of sound frequencies, even when saturated with compressor fluids, and further characterized by stability at high temperatures and fluctuating pressures experienced in normal compressor operation, and wherein the muffler attenuates sound generated by the operation of the compressor so that the sound does not bypass the muffler, substantially reducing sound retransmitted to the compressor housing;

a gas inlet port to receive refrigerant fluid from the exhaust tube;

a compressor mechanism that receives refrigerant fluid from the exhaust tube;

an electric motor to drive the compressor mechanism to compress the refrigerant fluid introduced from the exhaust tube;

and a gas discharge port the exhausts the compressed refrigerant fluid into a refrigerant system.

22. The compressor of claim 21 wherein the compressor is a reciprocating compressor.

23. The compressor of claim 21 wherein the resistive muffler attenuates sound by at least 6 decibels in the frequency range from about 400 Hz to about 5000 Hz.

24. The compressor of claim 21 wherein the acoustic foam assembly includes an acoustic foam selected from the group consisting of melamine and fiber absorbing material encased in a material inert to refrigerant fluids.

25. The compressor of claim 24 wherein the material inert to refrigerant materials is mylar.

* * * * *

UNITED STATES PATENT AND TRADEMARK OFFICE

CERTIFICATE OF CORRECTION

PATENT NO. : 6,840,746 B2
APPLICATION NO. : 10/188276
DATED : January 11, 2005
INVENTOR(S) : Marshall et al.

It is certified that error appears in the above-identified patent and that said Letters Patent is hereby corrected as shown below:

Claim 21, Column 10, Line 36: "port the exhausts" should be --port that exhausts--.

Signed and Sealed this

Fourth Day of September, 2007

JON W. DUDAS
*Director of the United States Patent and Trademark Office*